United States Patent [19]

Eguchi

[11] 4,392,441

[45] Jul. 12, 1983

[54] SEWING MACHINE WITH BUTTONHOLE STITCHING MECHANISM

[75] Inventor: Yasukata Eguchi, Kunitachi, Japan

[73] Assignee: Janome Sewing Machine Co. Ltd., Tokyo, Japan

[21] Appl. No.: 249,664

[22] Filed: Mar. 26, 1981

[30] Foreign Application Priority Data

Mar. 31, 1980 [JP] Japan ..... 55-41583[U]

[51] Int. Cl.[3] ..... D05B 3/06

[52] U.S. Cl. ..... 112/158 B

[58] Field of Search ..... 112/158 B, 158 C

[56] References Cited

U.S. PATENT DOCUMENTS 3,075,483 1/1963 Engel ..... 112/158 B 3,254,618 6/1966 Eguchi ..... 112/158 C

FOREIGN PATENT DOCUMENTS 1049851 6/1979 Canada ..... 112/158 B

*Primary Examiner*—Werner H. Schroeder

*Assistant Examiner*—Andrew M. Falik

*Attorney, Agent, or Firm*—Michael J. Striker

[57] ABSTRACT

A sewing machine which has a stitch-producing arrangement mounted on a housing and including a feeding device for selectively feeding the material to be sewn in one of two opposite feeding directions, and a needle reciprocable through the material and swingable transversely of the feeding directions when operated by a drive, comprises a stitch pattern control arrangement. The control arrangement includes a plurality of pattern cams rotated by the drive, a plurality of operator-controlled pattern selecting elements movable between operative and inoperative positions and a plurality of cam followers acted on by the selecting elements to engage the associated pattern cams in the operative position of the respective selecting element. A holder which holds the respective selecting element in its operative position and a feed adjusting arrangement which changes the feeding direction and discontinues the operation of the feeding device in dependence on which of the selecting elements is in its operative position are provided in the control arrangement. An operator-controlled needle-swing amplitude adjusting device is further provided, which is biased toward a first position and can be moved to a second position to displace the needle into a predetermined position and to cause the holder to release the respective selecting element then held thereby. The amplitude adjusting arrangement may include two cams one of which controls the displacement of the needle and the other the release of the holder.

3 Claims, 13 Drawing Figures

SEWING MACHINE WITH BUTTONHOLE STITCHING MECHANISM

BACKGROUND OF THE INVENTION

The invention relates to a sewing machine, and more particularly to a buttonhole stitching mechanism of the sewing machine, especially one adapted to produce additional finishing stitches at the end of a buttonhole to prevent the loosening of the thread. For attaining this object, an operator-controlled device is provided to displace the needle to a predetermined position after a series of buttonhole stitches has been formed to produce a predetermined number of additional stitches.

In the conventional mechanical sewing machines, it has been very troublesome and time consuming to produce the finishing stitches at the end of buttonhole because these sewing machines fail to provide a suitable structure for operation by the machine operator.

SUMMARY OF THE INVENTION

The invention has been provided to eliminate such defects and disadvantages of the prior art. It is a basic object of the invention to provide a sewing machine with a buttonhole stitching mechanism which is simple in structure and easy in operation.

It is another object of the invention to improve the efficiency of buttonhole stitching.

The other features and advantages of the invention will be apperent from the following description in reference to a preferred embodiment of the invention.

DETAILED DESCRIPTION OF THE PREFERRED EMBODIMENT

Figure 1:
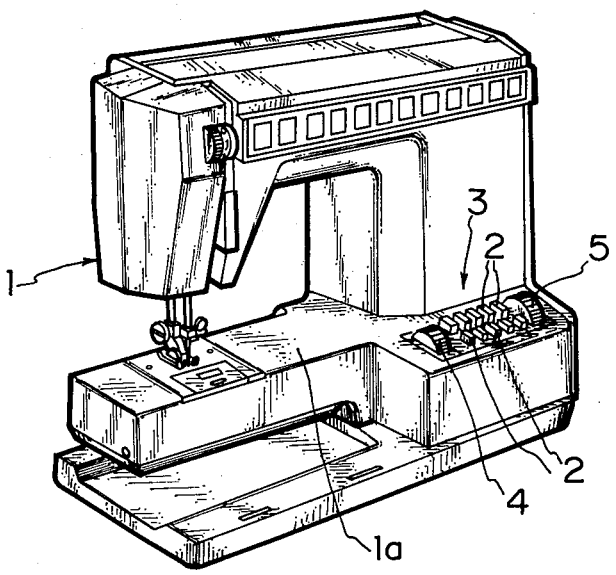
FIG. 1 is a perspective view of a sewing machine incorporating the inventive device.

In reference to FIG. 1 a sewing machine 1 has a pattern selecting mechanism 3 provided in a base 1*a* at the front side thereof. The pattern selecting mechanism 3 is provided with a number of operator-controlled selecting buttons 2 operated to select as many patterns to be stitched, a feed adjusting dial 4 and a needle amplitude adjusting dial 5 each accessible to the machine operator. In reference to FIGS. 2 and 4, the pattern selecting buttons 2 are secured to as many arms 6 respectively, which are each at the inner end thereof turnably mounted on a transverse shaft 8 fixedly mounted an a bracket 7 and are spaced from each other by collars 9 and rings 10 and are prevented from displacement axially of the shaft 8 by a collar 11 and an E-ring 12 each secured to the shaft 8.

Figure 4:
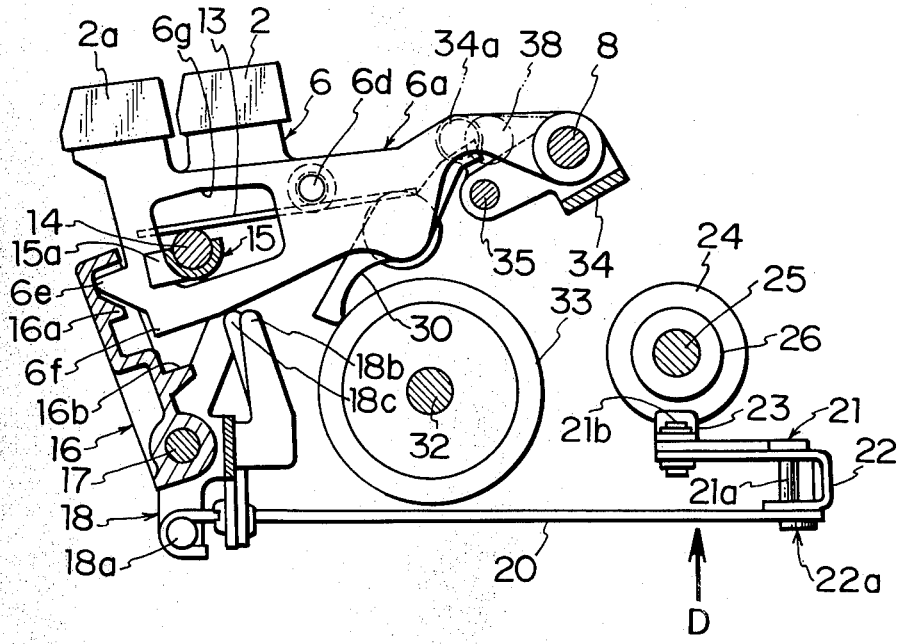

The arms 6 are each normally biased in the clockwise direction as seen in FIG. 4 around the shaft 8 by a torsion spring 13 which is mounted on a pin 6*d* provided at the intermediate part of each arm 6. The rightward end of the torsion spring 13 presses against the arm 6 and the leftward end of the torsion spring 13 presses against a transverse shaft 14 which is mounted on the bracket 7 to thereby bias the arm 6 in the clockwise direction around the shaft 8. The transverse shaft 14 is provided over its length thereof with a cushioning member 15 which is semicircular in vertical section and is pressed against by a bottom of a cutout 6*g* of each arm 6. The cushioning member has a number of lateral projections 15*a* each for guiding the respective arm 6 during its up and down movement.

Figure 5:
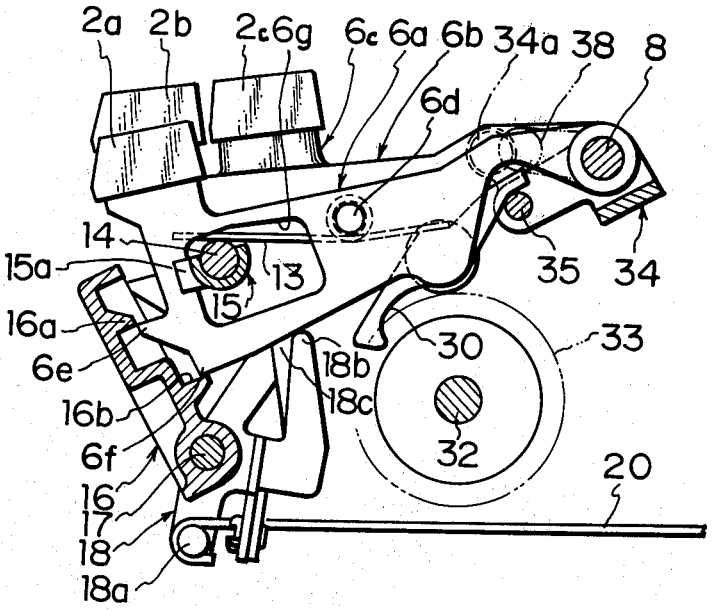

A lower end of a holder 16 is turnably mounted on a transverse shaft 17 secured to the bracket 7, and is normally biased in the clockwise direction. The holder 16 is formed with upper guide projections 16*a* and lower abutments 16*b* each cooperating with a projection 6*e* and a lower face 6*f* of the associated arm 6. Therefore, if one of the pattern selecting buttons 2 is depressed until the movement is stopped by the abutment of the lower face 6*f* of the arm 6 with the abutment 16*b* of the holder 16, the holder 16 is turned in the counterclockwise direction by the projection 6*e* of the arm 6 engaging the guide projection 16*a* of the holder 16 as shown in FIG. 5. Then if the depressed button 2 is released, the holder 16 is returned to the initial operative position to hold the arm 6 in the lower pattern selecting position as shown in FIG. 6.

Figure 2:
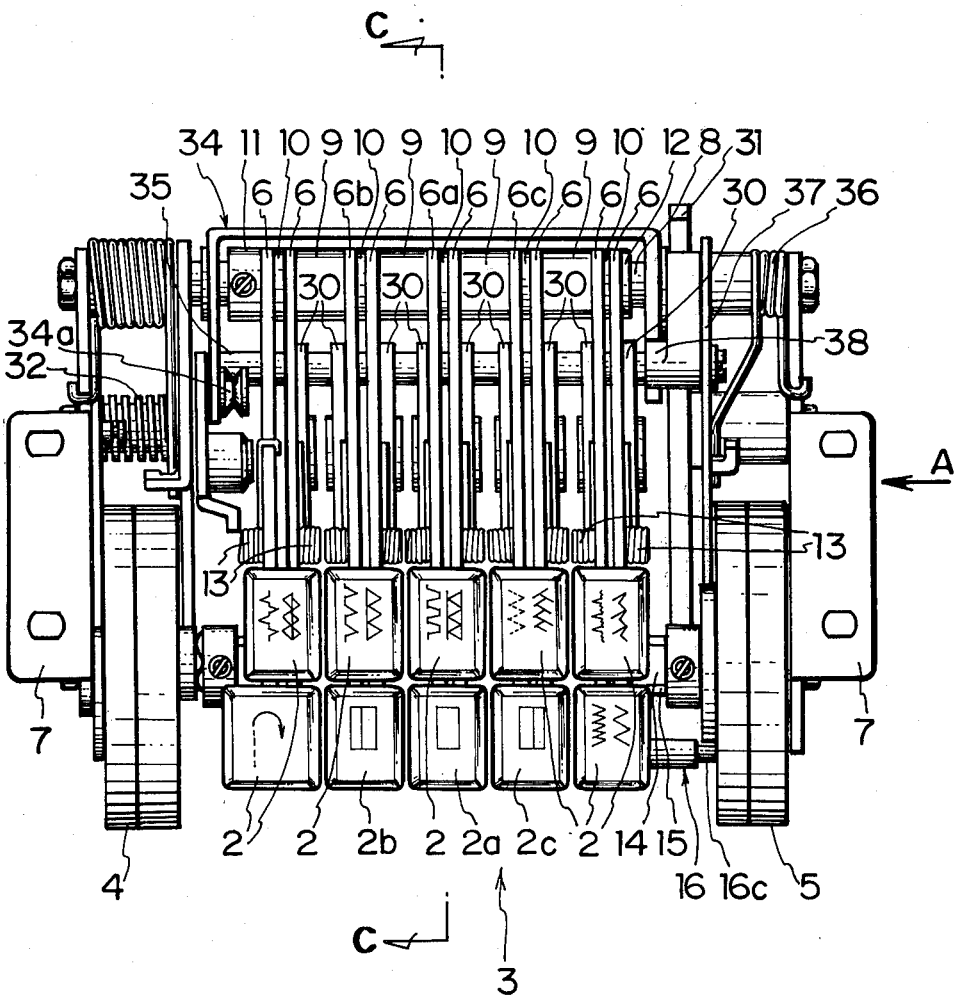
FIG. 2 is a plan view of a pattern selecting device.
Figure 3:
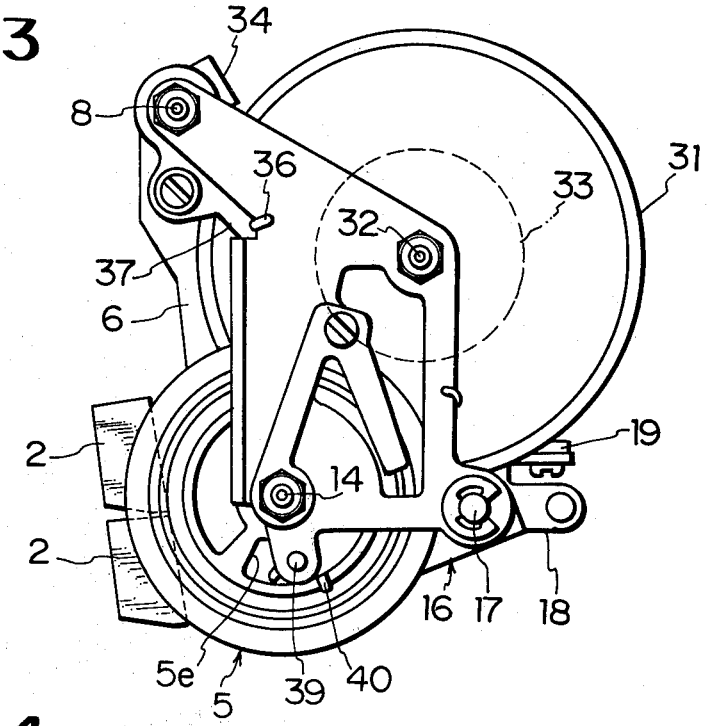
FIG. 3 is a view seen from "A" in FIG. 2, FIGS. 4 to 6 are views taken on the line "C—C" in FIG. 2, in which the pattern selecting device is selectively operated.
Figure 7:
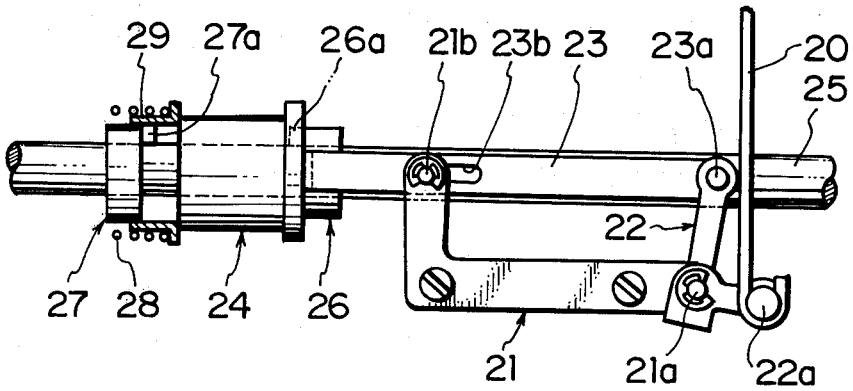
FIGS. 7 and 8 are plan views showing a feed adjusting device of the invention in different operating conditions.
Figure 8:
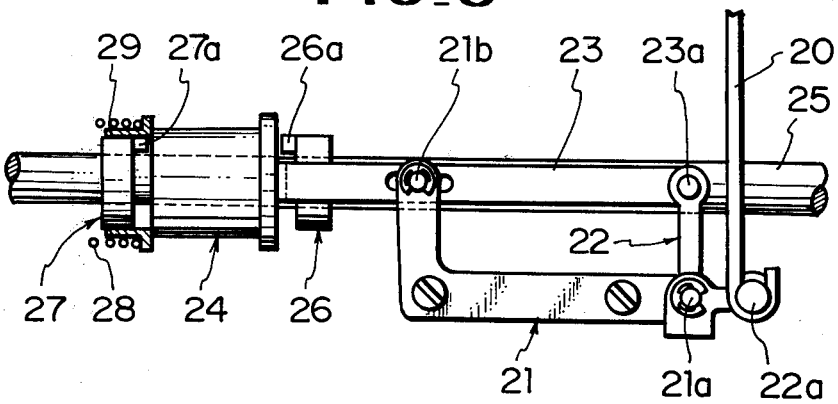

A feed switching lever 18 is turnably mounted on the transverse shaft 17 and has a lower arm 18*a* and upper offset arms 18*b*, 18*c* located below the arms 6*a*, 6*b* respectively to cooperate therewith. The arm 6*a* carries thereon the button 2*a* for selecting the bar-tack stitches of a buttonhole. The arm 6*b* carries thereon the pattern selecting button 2*b* for selecting the left side line-tack stitches of the buttonhole, and the arm 6*c* carries thereon the pattern selecting button 2*c* for selecting the right side line-tack stitches of the buttonhole as shown in FIG. 2. The feed switching lever 18 is connected at the lower arm 18*a* thereof to a pin 22*a* at one end of a feed control lever 22 by means of a connecting rod 20 as shown in FIGS. 7 and 8. The feed control lever 22 is turnably mounted on a pivot 21*a* of a frame 21 secured to the machine base 1*a*, and has the other end connected by a pin 23*a* to the free end of a transmission plate 23, which is at the other end secured to a feed control cam 24 and is displaceable in its longitudinal direction due to guidance of a pin 21*b* in a slot 23*b* of the transmission plate 23.

The feed control cam 24 is provided to feed a fabric to be sewn, in the forward or backward direction along a horizontal plane, in cooperation with another mechanism (not shown) vertically reciprocating the feed dog (not shown). The feed control cam 24 is mounted on a lower shaft 25 which is rotated with respect to the cam 24 in a timed relation with an upper drive shaft (not shown). The feed control cam 24 is displaceable axially of the lower shaft 25. The feed control cam 24 is formed on both ends thereof with grooves (not shown) respectively at different angular positions. These grooves are to engage fixed projections 26*a*, 27*a* respectively which are provided on collars 26, 27 secured to the lower shaft 25 for rotation therewith on both sides of the feed control cam 24. The feed control cam 24 is normally biased by a spring 28 through a flanged member 29 in the rightward direction in FIG. 7 where the feed control cam 24 is in engagement with the projection 26*a* of collar 26 for controlling the feed control cam 24 to feed the fabric in the forward direction, and is spaced from the projection 27*a* of collar 27 for controlling the feed cam 24 in the backward direction.

Figure 6:
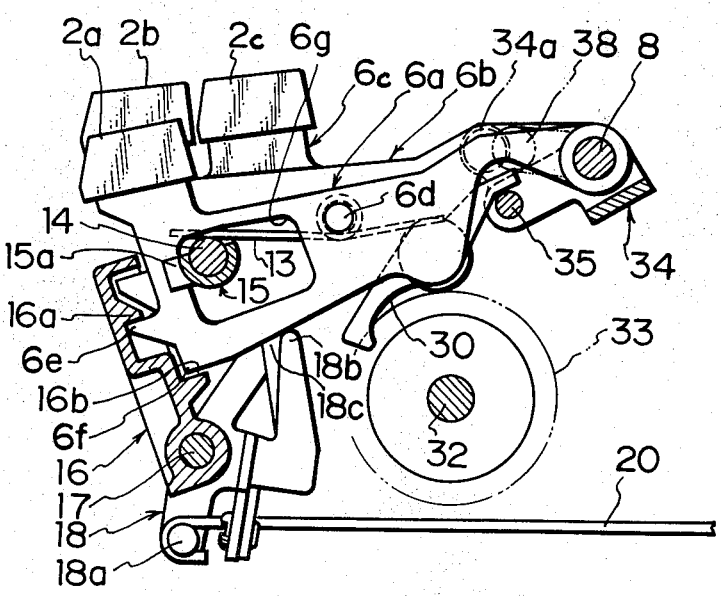

In reference to FIGS. 6–8 showing the operation of buttonhole selection, if the bar-tack stitch selecting button 2*a* is depressed, the arm 6*a* is operated to depress the upper arm 18*b*. As a result, the lever 18 is turned in the clockwise direction. Then the feed control lever 22 is turned in the counterclockwise direction by way of the connecting rod 20, and the feed control cam 24 is then moved in the leftward direction against the action of the spring 28 to a neutral position as shown in FIG. 8 where the feed control cam 24 is free from both of the feed direction control collars 26, 27. The horizontal feed movement is, therefore, not transmitted to the feed dog. If the pattern selecting button 2*b* is depressed, the arm 6*b* is operated to depress another upper arm 18*c* while the arm 6 is released and returned to the initial inoperative position. Then the lever 18 is further turned in the counterclockwise direction. As a result, the feed control cam 24 is further moved in the leftward direction against the action of the spring 28 and comes to engage the leftside collar 27. Then the feed control cam 24 is rotated together with the lower shaft to feed the fabric in the backward direction at a feeding pitch substantially equal to the forward feeding pitch which is produced when the feed control cam 24 is in engagement with the right side collar 26.

As shown in FIGS. 2, 4, 5 and 6, a number of cam followers 30 is provided, and each turnably mounted on each arm 6. A number of pattern cams 33 formed in a unit is rotatably mounted on a transverse shaft 32, and a gear 31 is secured to one end of the cam unit 33. These pattern cams 33 are each selectively engaged by the associated cam follower 30 on the associated arm 6 when the pattern selecting buttons 2 are selectively depressed. Each of the cam followers 30 has one end for engaging the associated pattern cam 33 and another end engaging a transverse shaft 35 mounted on a U-shaped frame 34 which is swingably mounted on the transverse shaft 8. The U-shaped frame 34 is provided with an output end 34*a* connected to a linkage (not shown) for transmitting the swinging movement of the U-shaped frame 34 to the needle bar (not shown). The U-shaped frame 34 is normally biased in the clockwise direction by the linkage as shown in FIG. 4. The clockwise movement of the U-shaped frame 34 is limited by a pin 38, as particularly shown in FIGS. 9 and 10, which is mounted on an amplitude limiting arm 37. The amplitude limiting arm 37 is at one end thereof turnably mounted on the transverse shaft 8 and is at the other end thereof pressed against an amplitude control cam 5*a* of an amplitude adjusting dial 5 by means of a torsion spring 36. The amplitude adjusting dial 5 is rotatably mounted on one end of a transverse shaft 14 secured to the bracket 7.

Figure 9:
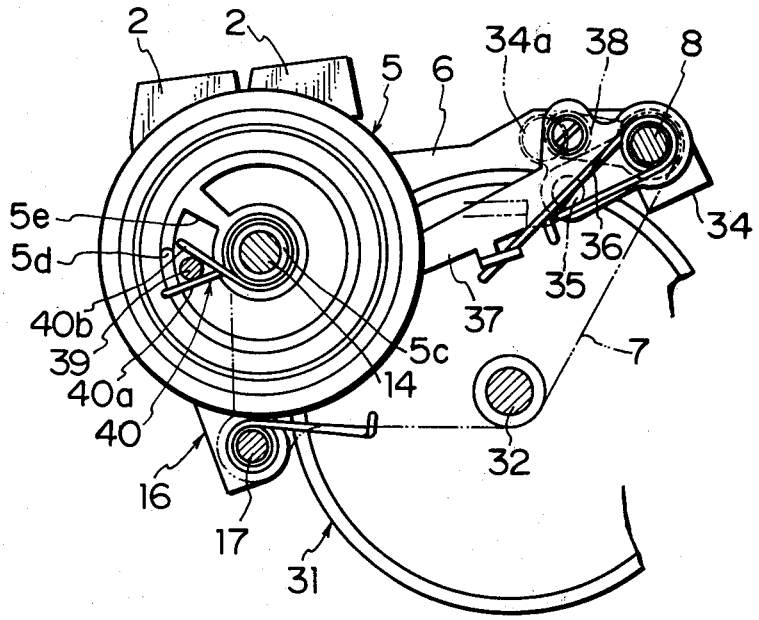
FIG. 9 is a side elevational view showing an amplitude adjusting device partly in section.
Figure 10:
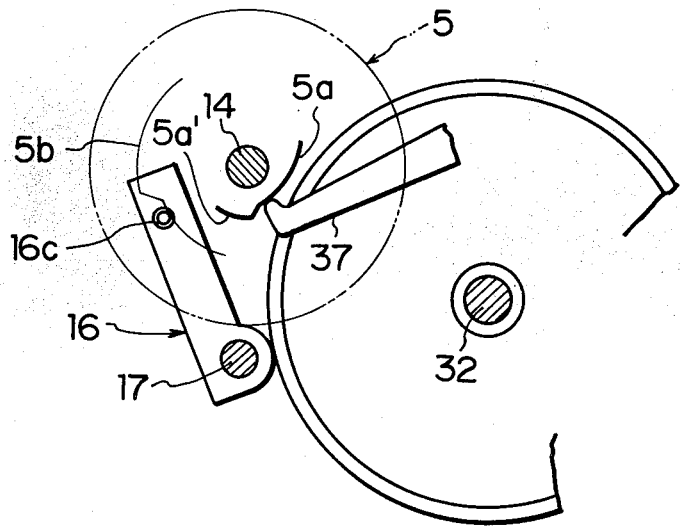
FIG. 10 is a partly sectioned, partly diagrammatic side elevational view of the device of FIG. 9 showing certain details, thereof.
Figure 11:
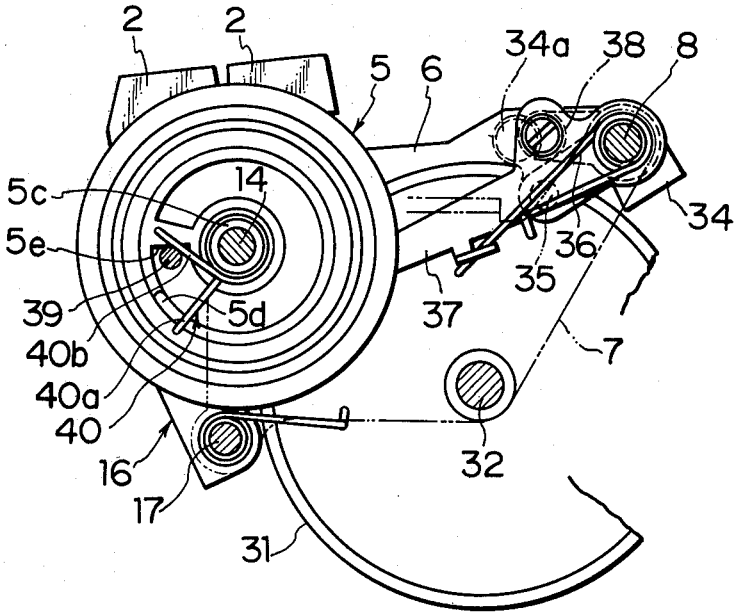
FIG. 11 is a side elevational view of the amplitude adjusting device shown in an operated condition.
Figure 12:
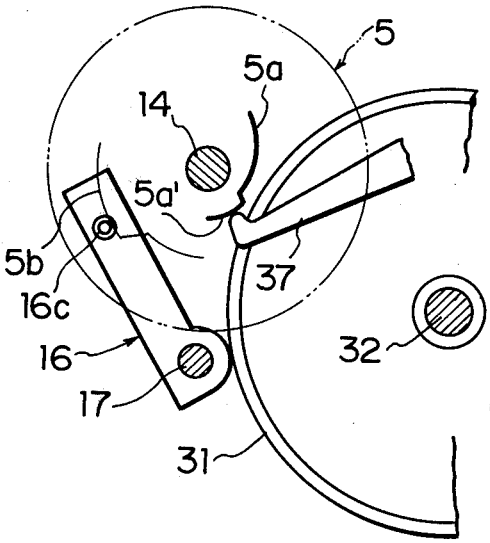
FIG. 12 is a view similar to FIG. 10 but in the position of FIG. 11.

As shown in FIGS. 2, 10 and 12, the holder 16 has a transverse pin 16*c* provided on one side thereof which is to be engaged by a cam 5*b* of the amplitude adjusting dial 5 as the latter is rotated. As shown in FIGS. 9 and 11, a transverse pin 39 is provided on the bracket 7. A torsion spring 40 is mounted around a boss 5*c* of the dial 5 and one end 40*a* of the spring 40 is pressed against the pin 39 on one side thereof and the other end 40*b* is pressed against the pin 39 on the other side thereof. The amplitude adjusting dial 5 is provided with a transverse projection 5*d* and an abutment 5*e*. If the dial 5 is rotated in the counterclockwise direction, the projection 5*d* engages the end 40*a* of the spring 40, and can be further rotated against the spring 40 until the abutment 5*e* of the dial 5 comes to engage the pin 39.

Figure 13:
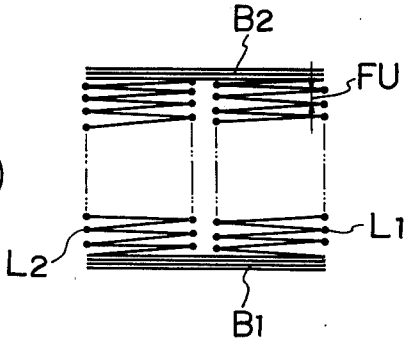
FIG. 13 is a plan view showing the stitches of a buttonhole.

To produce the buttonhole stitches according to the invention, the feed adjusting dial 4 is rotated to adjust the fabric feeding amount for a buttonhole to be stitched, and the amplitude adjusting dial 5 is rotated to a position as shown in FIG. 9 where the projection 5*d* of the dial 5 engages the end 40*a* of the torsion spring 40. Then if a pattern selecting button 2*c* is depressed to produce the right line-tack stitches of the buttonhole, the associated arm 6*c* is depressed and held by the holder 16 in the lower operative position where the follower 30 engages the associated buttonhole cam 33. As a result, the right line-tack stitches $L_1$ in FIG. 13 are produced at a reduced amplitude with the fabric feeding in the forward direction, since the feed control cam 24 is in engagement with the right collar 26 as shown in FIG. 7.

Then if the pattern selecting button 2*a* is depressed, the associated arm 6*a* is depressed and held by the holder 16 in the lower operative position while the arm 6*c* is released and returned to the initial upper inoperative position. As a result, the bar-tack stitches $B_1$ are produced at an enlarged amplitude with the fabric feeding discontinued, since the feed control cam 24 becomes spaced from the right feed control collar 26 and is also free from the left control cam 27 as shown in FIG. 8.

Then if the pattern selecting button 2*b* is depressed, the associated arm 6*b* is depressed and held by the holder 16 in the lower operative position while the arm 6*a* is released and returned to the initial upper inoperative position. As a result, the left line-tack stitches $L_2$ are produced at a reduced amplitude with the fabric feeding in the backward direction, since the feed control cam 24 comes to engage the left feed control collar 27.

Then if the pattern selecting button 2*a* is depressed again, the upper bar-tack stitches $B_2$ are produced with the fabric feeding discontinued, since the feed control cam 24 is moved to the position in FIG. 8 where the feed control cam 24 is spaced from the left feed control collar 27 and is also free from the right feed control collar 26.

Finally if the amplitude adjusting dial 5 is rotated in the counterclockwise direction against the action of spring 40 from the position as shown in FIG. 9 to the position as shown in FIG. 11 until the abutment 5*e* of the dial 5 engages the stopper pin 39, and is maintained there, the cam 5*b* of the dial 5 engages the pin 16*c* of the holder 16 to turn the latter in the counterclockwise direction as shown in FIG. 12. As a result, the arm 16*a* is released and returned to the initial upper inoperative position. Simultaneously the cam 5*a*′ of the dial 5 displaces the amplitude control arm 37 around the shaft 8 against the action of spring 36. The U-shaped frame 34 is, therefore, turned in the counterclockwise direction by the pin secured to the amplitude control arm 37. As a result, the output end 34*a* of the U-shaped frame 34 displaces, through the linkage, the needle to a position slightly inside of the rightward end of bar-tack stitches.

During the following operation of the sewing machine, the straight stitches FU are produced with the fabric feeding in the forward direction in the same pitch as in the right line-tack stitches, $L_1$ thereby to finish up the buttonhole stitches. Then if the amplitude adjusting dial 5 is released, it is returned to the position as shown in FIG. 9 by the action of spring 40, and at the same time the holder 16 is returned to the initial operative position as shown in FIG. 4.

I claim:

1. In a sewing machine having a machine housing and a stitch-producing arrangement mounted on the machine housing and including a feeding device operative for selectively feeding the material to be sewn in a selected one of two opposite feeding directions, a needle reciprocable through the material being sewn and swingable transversely of the feeding directions, and a drive operatively connectable to the feeding device and to the needle and operative for operating the same, a stitch pattern control arrangement comprising, in combination, a plurality of pattern cams mounted on said machine housing for rotation about an axis; means for rotating said pattern cams in dependence on the operation of said drive; a pattern selecting device including a plurality of operator-controlled pattern selecting elements mounted on said machine housing for movement between operative and inoperative positions, and a plurality of cam followers operatively connected to the respective pattern selecting elements to engage the respectively associated pattern cams in said operative position, and disengage the same from said pattern cams in the inoperative position, of the respective pattern selecting element; means for holding said pattern selecting elements in said operative positions until released; feed adjusting means operatively connected to said feeding device and operative for changing the feeding direction and for discontinuing the feeding operation of the feeding device in dependence on which of said pattern selecting elements is in said operative position thereof; and operator-controlled needle-swing amplitude adjusting means movable from a first to a second predetermined position and operative for displacing said needle to a predetermined position and for causing said holding means to release the respective pattern selecting element then held thereby for return to said inoperative position thereof during such movement, said amplitude adjusting means including a cam movable between said first and second predetermined positions, and a control arm tracing said cam and operatively connected to said needle to displace the same into said predetermined position thereof during said movement of said cam from said first to said second predetermined position thereof.

2. The stitch pattern control arrangement as defined in claim 1, wherein said amplitude adjusting means further includes another cam movable with said cam between said first and second predetermined positions and acting on said holding means to cause the same to release the respective pattern selecting element during said movement from said first to said second predetermined position.

3. The stitch pattern control arrangement as defined in claim 1; and further comprising means for returning said amplitude adjusting means to said first predetermined position upon release of said amplitude adjusting means by the operator.

* * * * *